US012565839B2

(12) United States Patent
Rataj et al.

(10) Patent No.: US 12,565,839 B2
(45) Date of Patent: Mar. 3, 2026

(54) DRIVER SOCKET FOR INSTALLATION OF A GROUND REINFORCEMENT BOLT

(71) Applicant: SANDVIK MINING AND CONSTRUCTION AUSTRALIA PTY LTD, Queensland (AU)

(72) Inventors: Mietek Rataj, New South Wales (AU); Bradley Darlington, New South Wales (AU); Warren Roach, New South Wales (AU); John Barry, New South Wales (AU); Peter Young, New South Wales (AU); Steven Weaver, New South Wales (AU); Osvaldo Vallati, New South Wales (AU)

(73) Assignee: Sandvik Mining and Construction Australia (Production/Supply) Ltd, Milton QLD (AU)

( * ) Notice: Subject to any disclaimer, the term of this patent is extended or adjusted under 35 U.S.C. 154(b) by 127 days.

(21) Appl. No.: 18/294,522

(22) PCT Filed: Aug. 1, 2022

(86) PCT No.: PCT/AU2022/050821
§ 371 (c)(1),
(2) Date: Feb. 1, 2024

(87) PCT Pub. No.: WO2023/010158
PCT Pub. Date: Feb. 9, 2023

(65) Prior Publication Data

US 2024/0344458 A1 Oct. 17, 2024

(30) Foreign Application Priority Data

Aug. 5, 2021 (EP) ..... 21189965

(51) Int. Cl.
*E21D 21/00* (2006.01)

(52) U.S. Cl.
CPC ..... *E21D 21/008* (2013.01); *E21D 21/0033* (2013.01)

(58) Field of Classification Search
CPC ..... E21D 21/008; E21D 21/0093; E21D 21/0033
See application file for complete search history.

(56) References Cited

U.S. PATENT DOCUMENTS 2,213,630 A * 9/1940 Gade ..... B21K 1/463 470/14
5,954,456 A * 9/1999 Bowles ..... E21D 21/0086 411/285

(Continued)

FOREIGN PATENT DOCUMENTS

GB 2137713 A 10/1984
WO 2010104460 A1 9/2010
WO WO-2020039340 A1 * 2/2020 ..... E21D 21/00

*Primary Examiner* — Benjamin F Fiorello
(74) *Attorney, Agent, or Firm* — Corinne R. Gorski

(57) ABSTRACT

A driver socket for installation of a ground reinforcement bolt is provided. The driver socket includes a cylindrical tube having a longitudinal axis, wherein a leading end of the driver socket is configured to be arranged in connection to the bolt and a trailing end of the driver socket is configured to be arranged in connection to a driving device. The driver socket includes a through hole having. The through hole has a varying cross-sectional area along its axial length. The through hole has comprising a first diameter in a mid-section thereof that is smaller than a second diameter in a leading section thereof. The through hole has a transition located between the mid-section and the leading section. The transition has a frustoconical shape. An installation system including a ground reinforcement bolt and the driver socket is also provided.

9 Claims, 2 Drawing Sheets

(56) References Cited

U.S. PATENT DOCUMENTS

| | | | | |
|---|---|---|---|---|
| 6,044,732 | A * | 4/2000 | Astle | B25B 13/48 81/177.5 |
| 6,244,787 | B1 | 6/2001 | Seegmiller | |
| 7,381,013 | B1 * | 6/2008 | Rataj | E21D 21/0033 405/259.5 |
| 7,802,943 | B2 * | 9/2010 | Walker | E21D 21/008 405/259.1 |
| 7,874,380 | B2 | 1/2011 | Mocivnik et al. | |
| 8,302,708 | B1 | 11/2012 | Cox et al. | |
| 10,626,724 | B1 | 4/2020 | Abreu et al. | |
| 2003/0052153 | A1 | 3/2003 | Peltonen et al. | |
| 2011/0311319 | A1 * | 12/2011 | Spearing | E21D 21/008 405/302.2 |
| 2017/0314394 | A1 | 11/2017 | Craig et al. | |
| 2018/0171800 | A1 | 6/2018 | Duffy et al. | |
| 2020/0340359 | A1 * | 10/2020 | Holden | E21D 21/006 |

* cited by examiner

DRIVER SOCKET FOR INSTALLATION OF A GROUND REINFORCEMENT BOLT

RELATED APPLICATION DATA

This application is a § 371 National Stage Application of PCT International Application No. PCT/AU2022/050821 filed Aug. 1, 2022 with priority from EP 21189965.3 filed on Aug. 5, 2021.

TECHNOLOGY FIELD

The present invention relates to a driver socket for installation of a ground reinforcement bolt.

BACKGROUND

Formations, such as rock formations or rock strata, are often reinforced using rock bolts. For example, rock bolts are commonly used for reinforcement of tunnel roofs and for stabilization of rock walls, slopes and dikes. Various types of rock bolts or anchors are used depending for example on the type of formation to be reinforced. Rock bolts are normally installed by mining machines such as jumbos or rock bolters.

A common type of rock bolt is the hydraulically expandable rock bolt provided with an expandable body to be driven into a formation and thereafter expanded by introduction of a pressurized pressure medium such that the expandable body presses against the wall of the borehole and thereby engages the formation.

Another type of rock bolt is the mechanical friction bolt. The mechanically expandable bolt comprises an elongate expandable outer body, sometimes referred to as a split tube, and a central rod extending inside the outer body from a trailing portion provided with a nut to a leading portion operatively connected to an expansion mechanism for expanding the outer body upon rotation of the central rod.

At installation of the mechanically expandable rock bolt in the formation, the driving device (comprising drifter, shank adapter) is operated to repeatedly impact the outer body of the bolt, thereby forcing the outer body into the formation. When the bolt is sufficiently far driven into the formation the bolt is expanded by rotation of the nut, which causes rotation of the central rod such that the expansion mechanism causes expansion radially of the outer body to prevent axial withdrawal. The nut may be a blind nut such that the nut can first be screwed onto a thread at the trailing portion of the central rod, wherein the central rod eventually bottoms out in the blind nut, thereby preventing further relative rotation between the central rod and the blind nut. This allows torque to be applied to the nut and further to the central rod for tensioning of the expansion mechanism of the bolt. Other means for preventing co-rotation between the central rod and nut are feasible, such as thread-locking fluid or a shearing pin, wherein a standard nut with through hole may be used instead of a blind nut.

Some friction bolts comprise an outer body but no expansion mechanism, wherein the bolt is forced into the formation with a press-fit to anchor the bolt in the formation. For many types of rock bolt, it is advantageous to rotate the blind nut after driving the bolt into the formation to thereby increase strength of the attachment of the bolt to the formation.

The driving device operated to repeatedly impact the outer body of the rock bolt uses a driver socket. The repeatedly impact of the outer body of the bolt is supported by the driver socket as well as the rotation of the bolt nut.

Typically, driver sockets are in threaded engagement with the driving device.

During installation of the rock bolt high forces impact the outer body with a nut of the rock bolt while hammering in the rock bolt. The nut is threadably attached to the trailing end of the rock bolt.

So, the known designs of driver sockets have the drawback that the nut gets impacted or burred, or even deteriorated during installation due to the hammering. This leads to that the rock bolt nut needs to be replaced, or otherwise causes difficulties when to be removed since the nut is not working appropriately. The nut might be adapted to display product information and the like at a display face. The display face is recessed axially into the nut. The display face might be subject to damage while hammering in the rock bolt. Accordingly, what is required is a driver socket that addresses the above problems and drawbacks.

SUMMARY

It is an objective of the present invention to provide a driver socket that acts on a rock bolt nut with less damage, so that the nut does not become worn out during installation. It is a further specific objective to use a display face on a rock bolt nut, where the display face is not deteriorated while hammering in the bolt that may otherwise render the information on the display face unreadable.

According to a first aspect of the present invention there is provided a driver socket for installation of a ground reinforcement bolt. The driver socket comprises a cylindrical tube with a longitudinal axis, wherein a leading end of the driver socket is adapted to be arranged in connection to the bolt and a trailing end of the driver socket is adapted to be arranged in connection to a driving device, and wherein the driver socket comprises a through hole. The through hole along its axial length has a cross-sectional area comprising a first diameter in a mid-section being smaller than a second diameter in the leading section; and wherein the through hole comprises a transition between the mid-section and the leading section with a frustoconical shape. This leads to that when hammering of the bolt takes place forces are more evenly distributed in the driver socket.

Optionally, the plane of the transition defines an angle in relation to the longitudinal axis, wherein the angle is in the range of 30° to 60°. This gives less damage to the bolt head.

Preferably, the angle is in the range of 40° to 50°. More preferably, the angle is defined to be 45°. These are optimal values that result in even less damage to the bolt head. Such a chamfer has the advantage to be concentric around the nut.

Preferably, the diameter ratio between the mid-section and the leading section is ½. More preferably, the diameter ratio between the mid-section and the leading section is ¼. These are relations between the diameters that make the through hole serve its purpose while at the same time not compromising the dimension of the driver socket so that the thickness of the outer wall becomes too narrow.

Optionally, the driver socket comprises an outside diameter being 60 mm. This is an optimal value to use for rock bolts.

According to a second aspect of the present invention there is provided an installation system comprising a ground reinforcement bolt and a driver socket, wherein the bolt is a mechanical friction bolt.

Optionally, the bolt comprises a nut at a trailing end, wherein the nut comprises a display face with indicia at its annular end. Such display face helps to identify the bolt.

BRIEF DESCRIPTION OF DRAWINGS

A specific implementation of the present invention will now be described, by way of example only, and with reference to the accompanying drawings in which.

DETAILED DESCRIPTION

Figure 1:
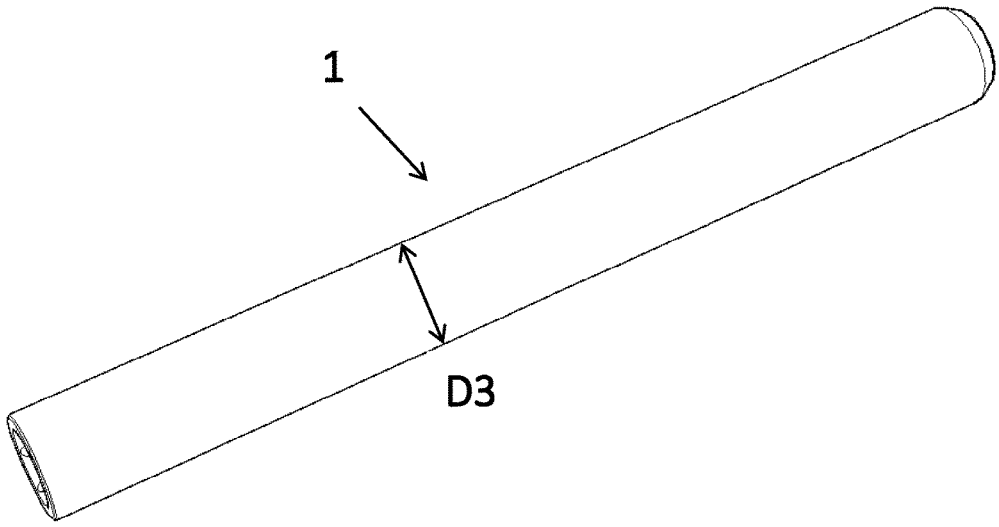
FIG. 1 is an external perspective view of a driver socket.

FIG. 1 discloses a driver socket according to a first embodiment and its use together with a mining machine will hereinafter be described with reference to the appended drawings. The driver socket 1 is used for installation of a ground reinforcement bolt in order to secure adequate ground support underground. When the bolt is inserted into the hole the driver socket 1 is rotated in order to complete the full engagement of the bolt in the formation. The driver socket 1 has an outside diameter D3 typically being 50, 60 or 70 mm.

Figure 2:
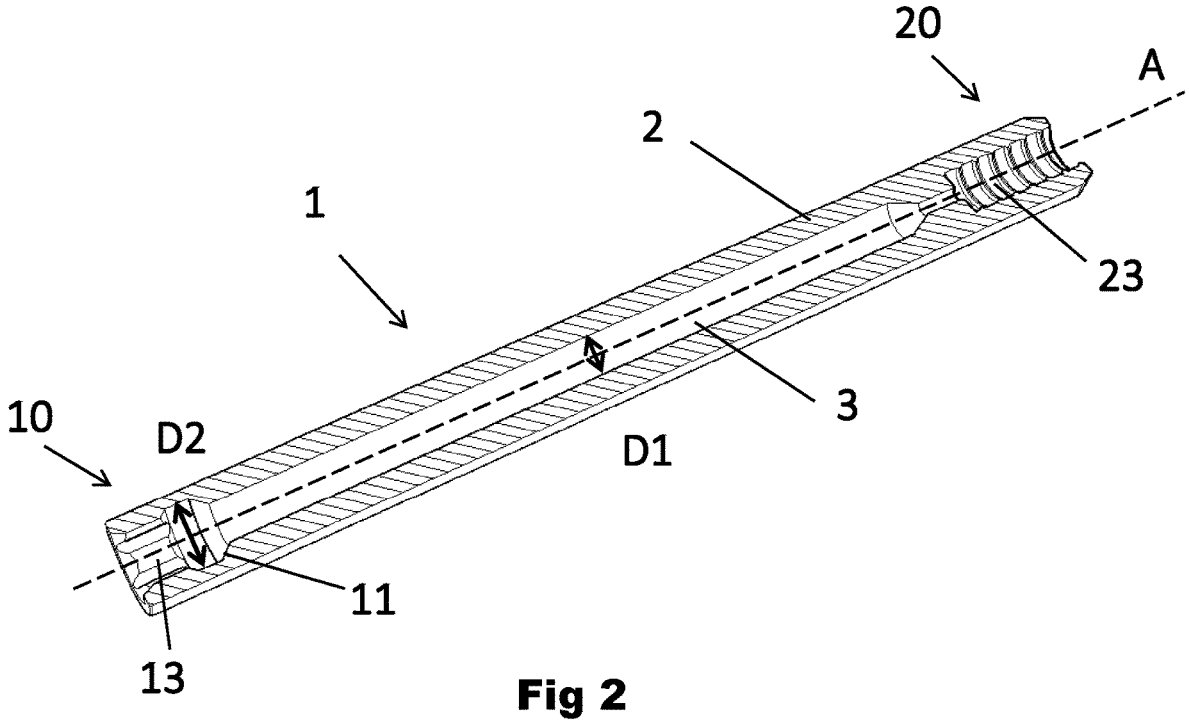
FIG. 2 is a cross-sectional perspective view of a driver socket.

Referring to FIG. 2, the driver socket 1 is disclosed to be orientated along a longitudinal axis A. The driver socket 1 has a leading end 10 that is intended to be arranged in connection to a rock bolt, and a trailing end 20 that is intended to be arranged in connection to a driving device. The driver socket 1 comprises a cylindrical tube 2 with a through hole having different sections comprising specific diameters, respectively. The through hole has a varying contour along its length. A mid-section 3 has a first diameter D1 of the cross-sectional area. At the leading end 10 there is a leading section 13 with a second diameter D2, which leading section 13 is chosen to fit the rock bolt nut. At the trailing end 20 there is a trailing section 23, which trailing section 23 is chosen to threadably engage with the driving device. The mid-section 3 has a longer longitudinal length then the leading section 13 and the trailing section 23 of the driver socket.

The mid-section 3 has the smallest diameter of the three sections. The value of diameter D1 is half of the value of diameter D2. The value of diameter D1 could also be one fourth of the value of diameter D2 or one fifth.

Between the mid-section 3 and the leading section 13 there is a transition 11. This is an intersection where the two sections meet. It is an inclined plane.

Figure 3:
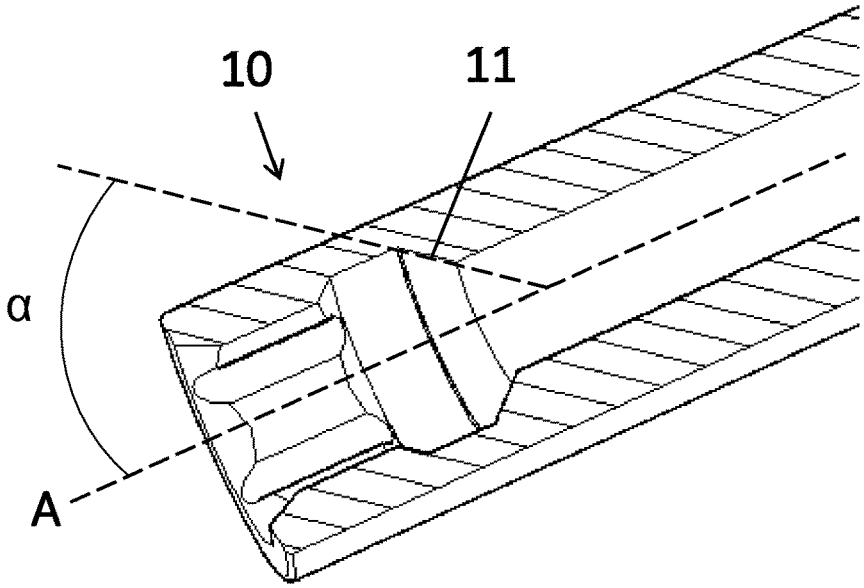
FIG. 3 is an enlarged cross-sectional perspective view of a driver socket.

In FIG. 3 the leading end 10 with the leading section is shown. The transition 11 with its inclined plane is defined to have a specific angle $\alpha$ in relation to the longitudinal axis A. This angle is an acute angle that should be well balanced, so it is not close to 90° nor close to 0°. A relevant value of the angle is somewhere in the range of 30° to 60°, more preferably 40°, 45° or 50°. This bevel gives a concentric fit around the nut.

Figure 4:
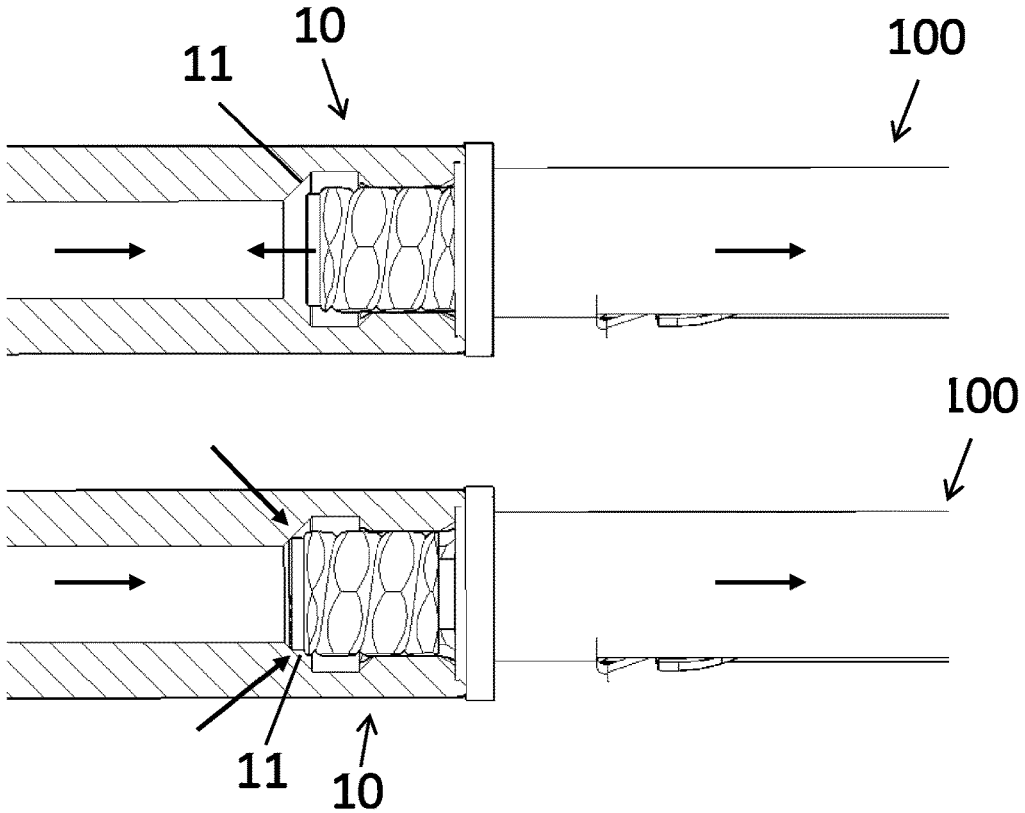
FIG. 4 is a side view showing the force transmittal in a driver socket and a rock bolt.

FIG. 4 discloses the leading end 10 with the leading section fitted around a ground reinforcement bolt 100. During hammering the driver socket moves slightly back and forward, so it can be said to rattle back and forth.

The upper part of the figure shows the situation when the hammering starts. This is before the bolt 100 gets into contact with the transition 11. The forces represented by arrows are shown to be transmitted purely in an axial longitudinal direction along the driver socket and the rock bolt.

The lower part of the figure shows the situation when the driver socket moves forward, in which situation the hammering continues. So, the bolt hits the leading end 10 of the socket and the transition 11 thus makes contact with the bolt. The forces will then be distributed so that they also comprise a radial component in addition to the axial forces. This is represented in the lower part of FIG. 4 by the resultant force arrows shown in connection to the transition 11, which resultant force arrows being perpendicular to the transition 11.

While hammering in the rock bolt the driver socket's leading end 10 alternates between the backward position shown in the upper part of FIG. 4 and the forward position shown in the lower part of FIG. 4.

The invention claimed is:

1. A driver socket for installation of a ground reinforcement bolt, the driver socket comprising:

a cylindrical tube having a longitudinal axis, wherein a leading end of the driver socket is configured to be arranged in connection to the bolt and a trailing end of the driver socket is configured to be arranged in connection to a driving device and a through hole having an axial length, wherein the through hole includes a leading section and a mid-section, and wherein the through hole along its axial length has a cross-sectional area including a first diameter (D1) in the mid-section and a second diameter (D2) in the leading section, the first diameter being smaller than the second diameter, and a transition located between the mid-section and the leading section, the transition having a frustoconical shape.

2. The driver socket as claimed in claim 1, wherein a plane of the transition defines an angle ($\alpha$) in relation to the longitudinal axis, wherein the angle ($\alpha$) is in a range of 30° to 60°.

3. The driver socket as claimed in claim 2, wherein the angle ($\alpha$) is in the range of 40° to 50°.

4. The driver socket as claimed in claim 3, wherein the angle ($\alpha$) is 45°.

5. The driver socket as claimed in claim 1, wherein a diameter ratio (D1/D2) between the mid-section and the leading section is ½.

6. The driver socket as claimed in claim 1, wherein the diameter ratio (D1/D2) between the mid-section and the leading section is ¼.

7. The driver socket as claimed in claim 1, further comprising an outside diameter being 60 mm.

8. An installation system comprising:

a ground reinforcement bolt; and a driver socket according to claim 1, wherein the bolt is a mechanical friction bolt.

9. The installation system according to claim 8, wherein the bolt includes a nut at a trailing end, and wherein the nut includes a display face with indicia at an annular end.

* * * * *